US009840083B2

(12) United States Patent
Ratjen et al.

(10) Patent No.: US 9,840,083 B2
(45) Date of Patent: Dec. 12, 2017

(54) METHOD FOR DAMPING PRESSURE PEAKS IN A LINE FOR INK OF AN INKJET PRINTER

(71) Applicant: HEIDELBERGER DRUCKMASCHINEN AG, Heidelberg (DE)

(72) Inventors: Hans-Juergen Ratjen, Bad Bramstedt (DE); Joerg-Achim Fischer, Laboe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/236,597

(22) Filed: Aug. 15, 2016

(65) Prior Publication Data

US 2017/0043589 A1 Feb. 16, 2017

(30) Foreign Application Priority Data

Aug. 13, 2015 (DE) ..... 10 2015 215 449

(51) Int. Cl.
*B41J 2/175* (2006.01)
*B41J 2/18* (2006.01)

(52) U.S. Cl.
CPC ..... *B41J 2/17596* (2013.01); *B41J 2/18* (2013.01)

(58) Field of Classification Search
CPC ..... B41J 2/17596; B41J 2/18
See application file for complete search history.

(56) References Cited

U.S. PATENT DOCUMENTS 5,380,164 A * 1/1995 Fry ..... B41J 2/17596 347/85
8,042,902 B2 10/2011 Katada
8,235,482 B2 8/2012 Katada
8,814,294 B2 8/2014 Shibata
8,926,072 B2 * 1/2015 Balala ..... B41J 2/175 347/85
9,289,979 B2 3/2016 Arimoto
(Continued)

FOREIGN PATENT DOCUMENTS

EP 2018970 A2 1/2009
EP 2574471 A1 4/2013
(Continued)

*Primary Examiner* — Sharon A Polk
(74) *Attorney, Agent, or Firm* — Laurence A. Greenberg; Werner H. Stemer; Ralph E. Locher

(57) ABSTRACT

A method for damping pressure peaks in an ink line of an inkjet printer includes connecting the line to a chamber divided by a diaphragm into an air-filled first space and an ink-filled second space, connecting the first space to an air-filled buffer, connecting the buffer to an air pump, a) pumping air into the first space until freeing the chamber of ink and the diaphragm rests on a chamber wall or tension in the diaphragm begins rising substantially linearly, then b) pumping air out of the first space until filling the chamber with ink and the diaphragm rests on a chamber wall or tension of the diaphragm begins rising substantially linearly, while determining the number of pump cycles, then c) pumping air into the first space while passing through substantially half of the determined pump cycles. Steps a and b may be reversed.

9 Claims, 3 Drawing Sheets

(56) References Cited

U.S. PATENT DOCUMENTS

| | | | | |
|---|---|---|---|---|
| 2005/0074337 | A1* | 4/2005 | Anderson | F04B 43/1253 417/44.11 |
| 2006/0209115 | A1* | 9/2006 | Espasa | B41J 2/17596 347/17 |
| 2006/0268078 | A1* | 11/2006 | Kumagai | B41J 2/175 347/85 |
| 2008/0136849 | A1* | 6/2008 | Kaneko | B41J 2/175 347/7 |
| 2008/0198207 | A1 | 8/2008 | Katada | |
| 2012/0026256 | A1 | 2/2012 | Shibata | |
| 2012/0140006 | A1* | 6/2012 | Yunoki | B41J 2/175 347/94 |
| 2014/0263431 | A1* | 9/2014 | Nilsson | B65D 83/42 222/61 |
| 2014/0362147 | A1* | 12/2014 | Blowfield | B41J 2/17526 347/86 |

FOREIGN PATENT DOCUMENTS

| | | | |
|---|---|---|---|
| EP | 2891558 | A1 | 7/2015 |
| JP | 2013071247 | A | 4/2013 |

* cited by examiner

METHOD FOR DAMPING PRESSURE PEAKS IN A LINE FOR INK OF AN INKJET PRINTER

CROSS-REFERENCE TO RELATED APPLICATION

This application claims the priority, under 35 U.S.C. §119, of German Patent Application DE 10 2015 215 449.1, filed Aug. 13, 2015; the prior application is herewith incorporated by reference in its entirety.

BACKGROUND OF THE INVENTION

Field of the Invention

The invention relates to a method for damping pressure peaks in a line for ink of an inkjet printer, in which the line is connected to a chamber in which a diaphragm divides the chamber into an air-filled first space and an ink-filled second space, the first space is connected to an air-filled buffer and the buffer is connected to an air pump.

When printing inkjet inks with one or more print heads, it is necessary to supply the print heads with the ink to be printed. For that purpose, storage containers, pumps and supply lines (or complex line systems, so-called manifolds) are usually provided. In so-called circulating systems, the ink is pumped from the storage container to the print head and non-printed ink from the print head is pumped back into the storage container again. In that case, a so-called bypass can also be provided in the ink supply line in parallel with the print head. Circulating ink supplies are used in particular when the demands on the printing quality and reliability are high. The advantages of a circulating supply are, firstly, the possibility of transporting entrained air out of the area of the nozzles of the print head and, secondly, of providing and maintaining the desired temperature of the ink.

One of the main requirements on an ink supply is for constancy of the so-called meniscus pressure. That is the pressure of the ink at the openings of the nozzles of the print head. That pressure is nominally generally slightly negative as compared with the surroundings (for example between about −5 and about −10 mbar). In order to ensure that pressure, pumps regulated to specific reference pressures are frequently used.

The print heads for the various inks are generally connected to a manifold and located parallel to one another. In that case, as a rule one manifold is provided for the so-called supply side and one manifold for the so-called return side (ink supply and ink removal). The respective pressure in a manifold is a controlled variable for a pump assigned to the manifold. The reference pressure in the return or supply manifold is determined from the desired meniscus pressure, the distribution of the internal resistances (the channels for the ink) of the print heads and the hydrostatic level of the manifold above the meniscus plane. In order to calculate the meniscus pressure, the pressure at the two manifolds can each be viewed as a potential which is distributed over the internal print head resistances.

During the printing, pressure modulation arises depending on the image content to be printed and the consequent ink consumption through the modulation of the volume flow of the ink in the respective lines and the internal head ink channels. Since the aforementioned controlled variables (the two pressures) are measured at the respective manifolds, they are not able to detect the pressure drops in the feed lines to the print heads and in particular within the heads.

Above and beyond those aforementioned pressure drops, however, a pressure drop also arises at the feed lines from the pumps to the manifolds which, although it can certainly be detected by the pressure sensors, as a rule cannot be controlled out with the necessary bandwidth. In that case, the bandwidth results from the image information and the printing speed (i.e. ultimately from the ink consumption). For that reason, damping of the pressure modulations at the manifold is necessary.

U.S. Pat. No. 8,042,902 B2 describes the determination of a liquid volume in a liquid chamber of a damper divided into two parts by a diaphragm. In that case, that is preferably half the overall volume of the damper, so that the diaphragm is able to oscillate within the damper without resting on a wall of the damper housing. The volume is determined by using a comparison of pressure pulsations which arise on the damper as a result of the pulsation of liquid pumps. The determination is carried out once by the volume of a small air chamber behind the diaphragm being decoupled from a greater buffer volume and another time by the two volumes being coupled. The two measured pulsation amplitudes can be converted into an air volume and therefore also into a liquid volume in the damper, given knowledge of the larger volume. The determination described can be repeated in printing pauses, in order to check the working point of the diaphragm.

SUMMARY OF THE INVENTION

It is accordingly an object of the invention to provide a method for damping pressure peaks in a line for ink of an inkjet printer, which overcomes the hereinafore-mentioned disadvantages of the heretofore-known methods of this general type.

With the foregoing and other objects in view there is provided, in accordance with the invention, a method for damping pressure peaks in a line for ink of an inkjet printer, the line being connected to a chamber in which a diaphragm is disposed and which is divided by the diaphragm into an air-filled first space and an ink-filled second space, the first space being connected to an air-filled buffer and the buffer being connected to an air pump. The method comprises the steps a to c:

a) pumping air into the first space until the chamber is freed of ink and the diaphragm rests on a wall of the chamber or the tension in the diaphragm begins to rise substantially linearly, then b) pumping air out of the first space until the chamber is filled with ink and the diaphragm rests on a wall of the chamber or the tension of the diaphragm begins to rise substantially linearly, the number of pump cycles being determined, then c) pumping air into the first space, substantially half of the determined number of pump cycles being passed through, or the steps d to f:

d) pumping air out of the first space until the chamber is filled with ink and the diaphragm rests on a wall of the chamber or the tension of the diaphragm begins to rise substantially linearly, then e) pumping air into the first space until the chamber is freed of ink and the diaphragm rests on a wall of the chamber or the tension of the diaphragm begins to rise substantially linearly, the number of pump cycles being determined, then f) pumping air out of the first space, substantially half of the determined number of pump cycles being passed through.

The method according to the invention permits pressure peaks in a line for ink of an inkjet printer to be damped reliably.

The method according to the invention can have the further step: g) damping pressure peaks with the diaphragm according to steps a to c or d to f in its rest position.

In accordance with another preferred mode of the invention, the air pressure—in the air pump, in the buffer, in the first space or in a line connecting these three—is measured, preferably by using a pressure sensor.

In accordance with a further preferred mode of the invention, step a) or step e) is ended as soon as the measured air pressure begins to rise significantly, preferably substantially linearly.

In accordance with an added preferred mode of the invention, step b) or step d) is ended as soon as the measured air pressure begins to fall significantly, preferably substantially linearly.

In accordance with an additional preferred mode of the invention, a peristaltic pump is provided as the pump and the pump cycles are determined by counting the steps of a motor of the pump. The motor of the pump is preferably a stepper motor, wherein the individual steps can be proportions of motor revolutions. The pump cycles counted can be non-integer, e.g. rational. Alternatively, a motor having a clock disk or a motor with gearbox can also be used and counting of the motor revolutions can be carried out.

In accordance with a concomitant preferred mode of the invention, the pressure of the ink is kept constant.

Other features which are considered as characteristic for the invention are set forth in the appended claims.

Although the invention is illustrated and described herein as embodied in a method for damping pressure peaks in a line for ink of an inkjet printer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
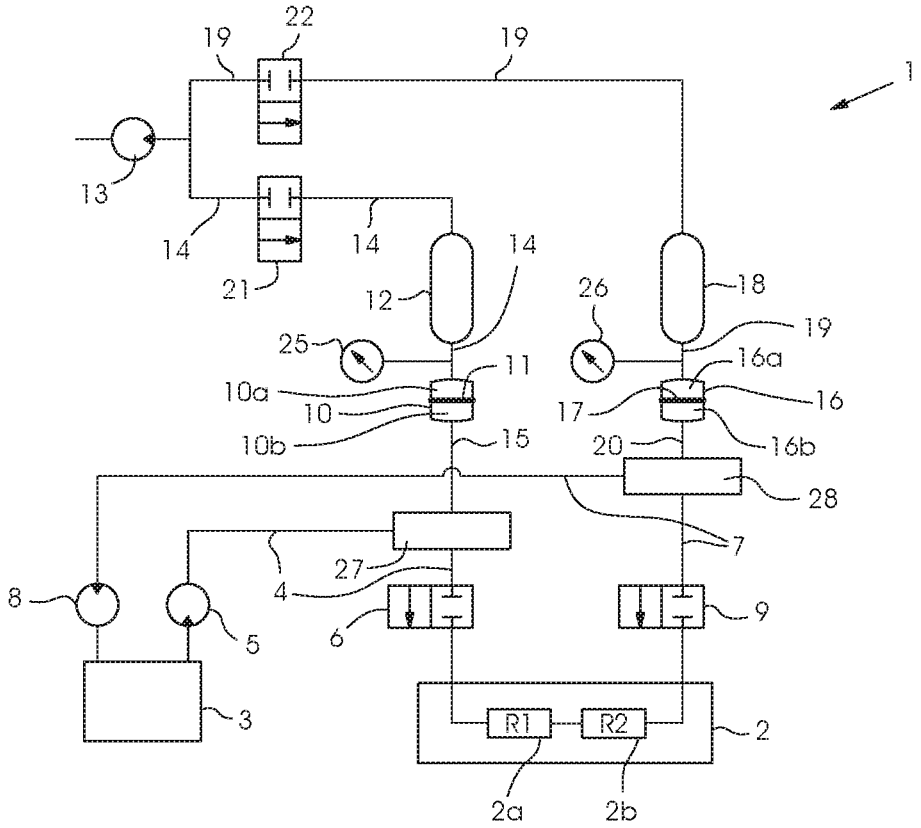
FIG. 1 is a schematic and block diagram showing an ink supply system of an inkjet printer during the performance of the method according to the invention.

Referring now to the figures of the drawings in detail and first, particularly, to FIG. 1 thereof, there is seen an ink supply system or ink supply device 1 which supplies a print head 2 with ink. Conventional print heads have in the interior a multiplicity of extremely small channels for the ink. These channels can be understood in simplified form as flow resistances 2*a* and 2*b*. The ink for the print head is initially stored in an ink storage container 3 and is conveyed from there to an input side of the print head through an ink line 4 in which a pump 5 is disposed. A valve 6, which can be opened and closed, is additionally provided in the ink line 4. An outlet side of the print head is connected to the ink storage container 3 through an ink line 7 in which a pump 8 is provided. A valve 9, which can be opened and closed, is also provided in this return line. The configuration described makes it possible for ink to be caused to circulate through the print head, i.e. to pump unused ink back into the ink storage container. A line system 27 (a so-called manifold), which is additionally provided on the so-called supply side of the ink supply device, can form a complex line system and for simplicity is merely schematically illustrated in the figure. A line system or so-called manifold 28 can also be provided on the so-called return side of the ink supply system and is also illustrated in a simplified manner in FIG. 1.

It is possible for pressure peaks, which are damped by the measures described below, to arise in the two ink lines 4 and 7 and in the two manifolds 27 and 28. The pressure peaks can be undesired fluctuations or modulations of the pressure of the ink liquid, for example pressure pulses which originate from the pumping or pressure pulses which are brought about by the starting or ending of the printing operation and the increased or reduced ink consumption associated therewith.

The supply side (ink line 4 and manifold 27) is connected through an ink line 15 to a chamber 10. The chamber 10 has a diaphragm 11 in its interior, which divides the chamber into a first space 10*a* and a second space 10*b*. Preferably, the chamber is constructed symmetrically and the diaphragm is disposed centrally. In a corresponding way, the return side (ink line 7 and manifold 28) is connected through an ink line 20 to a chamber 16. A diaphragm 17 is also provided in the chamber 16, dividing the interior of the chamber into a first space 16*a* and a second space 16*b*.

On one hand, the respective second space 10*b* or 16*b* of the chamber 10 or 16 is filled with ink, provided that the respective diaphragm 11 or 17 is in its rest position. On the other hand, the two opposite first spaces 10*a* and 16*a* are filled with air, provided that the respective diaphragm is in its rest position. The supply of the first spaces 10*a* and 16*a* with air is carried out by an air pump 13. An air line 14 leads from the pump 13 to a buffer 12 and from there onward to the first space 10*a*. A valve 21, which can be opened and closed, is provided between the air pump 13 and the buffer 12. A pressure sensor 25 is provided between the buffer 12 and the first space 10*a*. In a corresponding way, an air line 19 leads through a buffer 18 to the first space 16*a*. A valve 22 which can be opened and closed, and a pressure sensor 26, are also provided in the air line 19.

Figure 2:
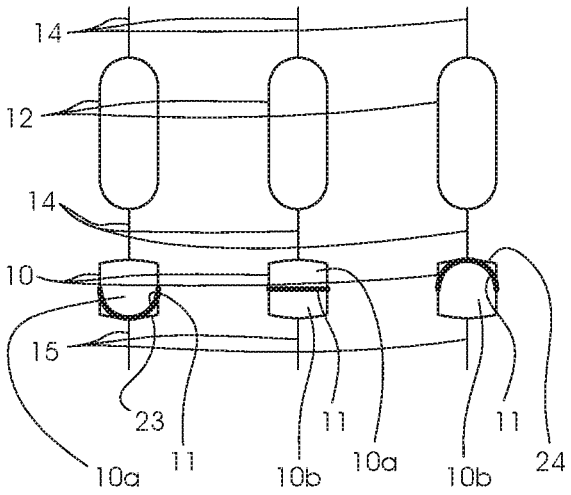
FIG. 2 is a schematic and block diagram of a portion of FIG. 1 showing three different states during the performance of the method according to the invention.

The following can be seen by looking at FIG. 2: The representation in the center shows, by way of example, the chamber 10 with the two spaces 10*a* and 10*b* and the diaphragm 11 in its rest position. In this case, the diaphragm 11 is in the rest position when there is the same volume of air or ink on both sides of the diaphragm, that is in the first and second spaces 10*a* and 10*b* (provided that the chamber is constructed symmetrically with respect to the two volumes and the diaphragm is fitted centrally). This is correspondingly true of the chamber 16.

On the other hand, the following situation is illustrated on the left-hand side of FIG. 2. The diaphragm 11 has been deflected out of its rest position and rests on a wall 23 of the chamber 10 within the latter. In the process, the volume of the second space 10*b* disappears substantially completely. In a corresponding way, on the right-hand side of FIG. 2, the opposite situation is illustrated, in which the diaphragm has been deflected out of its rest position in such a way that the volume of the first space 10*a* disappears substantially completely. In this case, the diaphragm 11 rests on another wall 24 of the chamber 10. Stops, on which the diaphragm 11 rests in its respective deflected position, could also be provided within the chamber 10 instead of the walls 23 and 24. The same is true of the chamber 16. The wall 23 or a corresponding stop is preferably constructed in such a way that the ink is not shut off by the diaphragm during operation, that is to say it can continue to flow. For this purpose, the wall can preferably be a lattice, so that the diaphragm rests on the lattice and the ink flows behind the lattice. Provision can also be made not to move the diaphragm as far as the respective wall but only until the tension of the diaphragm begins to rise substantially linearly, for example because the diaphragm begins to stretch. The increase can be positive or negative. The instant of the transition from substantially constant tension to substantially linearly rising tension of the diaphragm can be measured through a corresponding air pressure change by using the pressure sensors 25 or 26.

The progress of the method according to the invention, which can be carried out with the previously-described ink supply device, will now be described below.

The pressure fluctuations produced by the modulation of the ink flow relate both to the supply side and also to the return side, that is to say both the ink line 4 and the manifold 27 and also the ink line 7 and the manifold 28. Depending on the magnitude of the two flow resistances 2*a* and 2*b* of the print head 2, the consumption flow of the ink is composed of an increase in the supply flow and a reduction in the return flow. For this reason, it is advantageous to provide and to perform damping of possible pressure peaks on both manifolds 27, 28 (damping devices 10 and 16, respectively).

The respective damping on the supply side and return side is achieved by the two chambers 10 and 16 and the use thereof. The pressure of the ink in the respective second space 10*b* and 16*b* is substantially equal to the pressure of the ink in the associated manifold 27 and 28. A slight deviation of the pressure can, however, result from the fact that the respective chamber 10 and 16 is disposed at a different level than the respective manifold 27 and 28.

As already described above, the two first spaces 10*a* and 16*a* are air-filled and are each connected to a respective buffer 12 and 18, in which case the respective buffer defines the spring hardness of the chamber 10 or 16 acting as damper.

The respective diaphragm 11 or 17 is constructed and disposed in such a way that, around its rest position, it builds up no or only a very little inherent tension, so that in the rest position only the volume of the respective first space 10*a* or 16*a*, together with the volume of the respectively associated buffer 12 or 18, is responsible for the respective spring hardness of the damper on the supply side and return side. The volume in the respectively associated air lines is assumed to be low, so that it can be disregarded.

The extreme case of ink flow modulation is the transition from non-printed area to solid area at full printing speed. During such a transition, the ink consumption rises highly abruptly as a result of the expulsion of ink droplets. The necessary volume flow jumps within 10 to 20 ms to a maximum value, as a result of which an abrupt pressure drop in the ink liquid is produced in the feed lines. The damper according to the invention is therefore constructed in such a way that the ink liquid volume which is consumed during the reaction time of a control loop for the ink supply through the pump 5 (about 0.5 seconds) can be supplied from the second space 10*b* and/or 16*b*. As a result of the removal of ink from the chamber 10 or 16 of the respective damper, the intention is for the pressure of the ink liquid not to change substantially.

In the following text, an example of the dimensioning is given: with an assumed printing speed v of 1 m/s, a printing width b of 1 m, a resolution r of 20 μm and a mass of a printing droplet V of 4 pl, the result is a maximum volume flow during printing of 540 ml/minute ($v*b*V/r^2$). Given a reaction time of the control loop of about 0.5 seconds, this results in a volume of 4.5 ml which the damper must be able to supply without the diaphragm thereof being deflected to such an extent that it begins to stretch and the spring hardness of the damper would increase abruptly as a result. Given a further assumption, that the permitted pressure change as a result of the consumption of ink from the ink volume of the damper may be about 5 mbar, the result is an ink volume of the damper of about 1 l (from the relationship p*V=constant).

In order then to ensure that the diaphragm of the damper is able to execute a sufficiently large displacement without its inherent tension increasing substantially, the diaphragm must be set into its central position or rest position and kept there if possible, in order to ensure that it can swing freely to both sides.

However, the position of the diaphragm is generally undetermined and, in its rest position, only an equalized pressure balance prevails on the two sides of the diaphragm, which means that the air pressure on one side of the diaphragm is equal to the operating pressure of the ink liquid on the other side of the diaphragm.

Since the direct measurement of the position of the diaphragm, for example by using a sensor sensing the position of the diaphragm directly, is not readily possible, the invention proposes to determine the rest position of the diaphragm as described below and, in this way, to be able to guide the diaphragm into its rest position.

Figure 3:
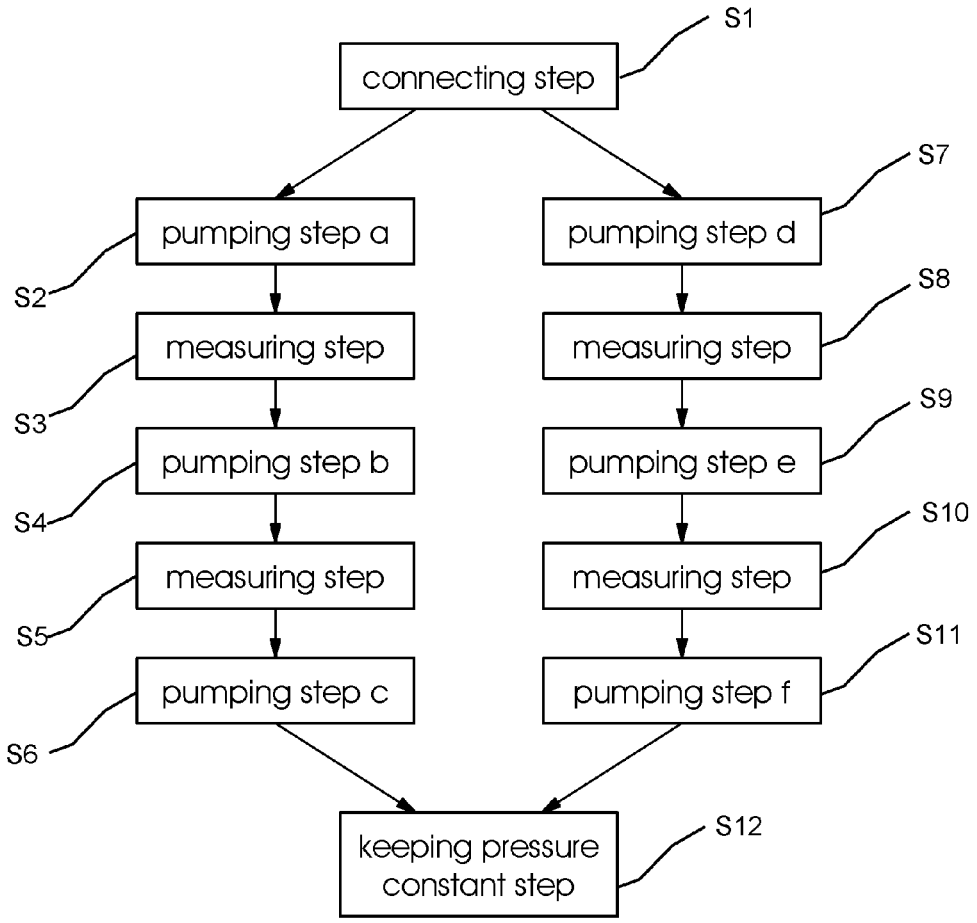
FIG. 3 is a flow diagram showing the steps of the method.

Firstly, as shown in FIG. 3, in a step S1, the lines are connected as described above. Then, in a step S2, air is pumped into the first space 10*a* or 16*a* until the chamber 10 or 16 or the second space 10*b* or 16*b* thereof is free of ink and the diaphragm 11 or 17 rests on the wall 23 of the chamber. At the instant at which the diaphragm rests on the wall 23, the air pressure begins to rise linearly. This rise takes place in accordance with a characteristic curve which is given by the volume of the buffer 12 or 18 and the volume of the first space 10*a* or 16*a*. Upon reaching an air pressure which can be measured sufficiently accurately with commercially available pressure sensors 25 or 26 in a step S3 and which marks the rise, the pumping of air into the respective first space is stopped. Then, in a step S4, by switching over the air pump 13, air is pumped out of the respective first space 10*a* or 16*a* of the chamber until the chamber or the respective second space 10*b* or 16*b* of the chamber is filled with ink and the diaphragm rests on a wall 24 of the chamber. The air pressure then begins to decrease in the direction of a vacuum. The time at which the diaphragm rests on the wall is in turn easy to determine by using a pressure sensor 25 or 26 in a step S5, since the pressure then begins to fall substantially linearly or linearly to a first approximation. During the pumping of air out of the first space, the number of pump cycles which take place between the resting of the diaphragm on the wall 23 and on the wall 24 is determined. For this purpose, for example, the steps or revolutions of a motor of the pump can be counted. Finally, in a step S6, air is again pumped into the first space 10*a* or 16*a* of the chamber 10 or 16, wherein substantially half of the previously determined number of pump cycles is passed through. This applies in the case of a symmetrical structure of the chamber. Should the volumes V1 and V2 of the two spaces of the chamber be in a ratio V1/V2 <>1, then the number of pump cycles during the refilling is adapted appropriately.

In this way, the diaphragm can be brought into its rest position in a straightforward way by using the existing pumps and by using pressure sensors. As already described above, the positioning of the diaphragm in its rest position is important for fault-free operation of the damper, in order to be able to damp pressure peaks in the ink line reliably.

During the above-described process, the operating pressure of the ink is preferably maintained.

The method described can also be carried out in a different order, wherein air is first pumped out of the first space 10*a* or 16*a* in a step S7 and then air is pumped into the first space again in a step S9, wherein the diaphragm rests firstly on the wall 24 and then on the wall 23. In the converse method, air is finally pumped out of the first space in a step S11, wherein substantially half of the determined number of pump cycles is passed through. A measuring step S8 takes place between steps S7 and S9 and a measuring step S10 takes place between steps S9 and S11. Finally, the method is completed by keeping the pressure constant in a step S12.

In addition, once the diaphragm has been set and centered, that is to say it is in its rest position, it may be necessary to carry out readjustment/re-centering: for example a) because the temperatures have changed or b) because the ambient air pressure (weather) has changed. Case a) is of lesser importance, since the device 1 is preferably located in a temperature-controlled environment. In case b), a permanent air pressure measurement can be provided. In the event of a change in the ambient air pressure by a specific, predefined value, re-centering is necessary. For the purpose of re-centering there are two possibilities: either during a printing pause or during printing operation.

An alternative method can be carried out as follows: the pump 5 is controlled in such a way that the diaphragm 11 is guided to the wall 24. In the process, the volume V1 of the first space 10*a* disappears. The buffer 12 (or the volume VP thereof) is at the same time connected to the atmosphere. After that, the buffer has an air pressure $p_{air}$ applied, which is dimensioned in such a way that the diaphragm 11 is guided into its rest position (with a given operating pressure $p_{oper}$ of the ink). The air pressure in this case is calculated in accordance with the formula $p_{air}=((VP+V1)/VP)*p_{oper}$.

The invention claimed is:

1. A method for damping pressure peaks in a line for ink of an inkjet printer, the method comprising the following steps:

connecting the line to a chamber having a diaphragm disposed in the chamber and dividing the chamber into an air-filled first space and an ink-filled second space, connecting the first space to an air-filled buffer and connecting the buffer to an air pump; and carrying out steps a) to c):

a) pumping air into the first space until the chamber is freed of ink and the diaphragm rests on a wall of the chamber or tension in the diaphragm begins to rise substantially linearly, then b) pumping air out of the first space until the chamber is filled with ink and the diaphragm rests on a wall of the chamber or the tension of the diaphragm begins to rise substantially linearly, and determining a number of pump cycles, then c) pumping air into the first space while passing through substantially half of the determined number of pump cycles, or carrying out steps d) to f):

d) pumping air out of the first space until the chamber is filled with ink and the diaphragm rests on a wall of the chamber or the tension of the diaphragm begins to rise substantially linearly, then e) pumping air into the first space until the chamber is freed of ink and the diaphragm rests on a wall of the chamber or the tension of the diaphragm begins to rise substantially linearly, and determining a number of pump cycles, then f) pumping air out of the first space while passing through substantially half of the determined number of pump cycles.

2. The method according to claim 1, which further comprises measuring air pressure in the air pump, in the buffer, in the first space or in a line connecting the air pump, the buffer and the first space.

3. The method according to claim 2, which further comprises measuring the air pressure by using a pressure sensor.

4. The method according to claim 2, which further comprises ending step a) or step e) as soon as the measured air pressure begins to rise.

5. The method according to claim 2, which further comprises ending step a) or step e) as soon as the measured air pressure begins to rise substantially linearly.

6. The method according to claim 2, which further comprises ending step b) or step d) as soon as the measured air pressure begins to fall.

7. The method according to claim 2, which further comprises ending step b) or step d) as soon as the measured air pressure begins to fall substantially linearly.

8. The method according to claim 1, which further comprises using a peristaltic pump having a motor as the pump, and determining the pump cycles by counting steps of the motor of the peristaltic pump.

9. The method according to claim 1, which further comprises keeping a pressure of the ink constant.

* * * * *